US011897724B2

(12) United States Patent
Yoshita

(10) Patent No.: US 11,897,724 B2
(45) Date of Patent: Feb. 13, 2024

(54) MEDIUM CONVEYING APPARATUS

(71) Applicant: PFU Limited, Ishikawa (JP)

(72) Inventor: Shogo Yoshita, Ishikawa (JP)

(73) Assignee: PFU LIMITED, Ishikawa (JP)

( * ) Notice: Subject to any disclaimer, the term of this patent is extended or adjusted under 35 U.S.C. 154(b) by 190 days.

(21) Appl. No.: 17/464,408

(22) Filed: Sep. 1, 2021

(65) Prior Publication Data

US 2021/0395031 A1 Dec. 23, 2021

Related U.S. Application Data

(63) Continuation of application No. PCT/JP2019/011924, filed on Mar. 20, 2019.

(51) Int. Cl.
*B65H 9/00* (2006.01)
*B65H 29/58* (2006.01)

(52) U.S. Cl.
CPC ..... *B65H 9/004* (2013.01); *B65H 29/58* (2013.01); *B65H 2301/331* (2013.01); *B65H 2511/24* (2013.01)

(58) Field of Classification Search
CPC .. B65H 9/004; B65H 29/58; B65H 2301/331; B65H 2404/725
See application file for complete search history.

(56) References Cited

U.S. PATENT DOCUMENTS 8,538,313 B2 * 9/2013 Tanaka ..... G03G 15/6567 399/401
8,991,824 B2 * 3/2015 Suzuki ..... B65H 85/00 271/301
9,221,644 B2 * 12/2015 Kobayashi ..... B65H 85/00
10,703,596 B2 * 7/2020 Yoshita ..... B65H 3/0661
2010/0150633 A1 6/2010 Tanaka

FOREIGN PATENT DOCUMENTS

JP S63-66241 U 5/1988
JP S63-178259 U 11/1988
JP 2010-143696 A 7/2010

OTHER PUBLICATIONS

International Search Report issued in corresponding International Patent Application No. PCT/JP2019/011924, dated Jun. 11, 2019, w/English translation.

* cited by examiner

*Primary Examiner* — Howard J Sanders
(74) *Attorney, Agent, or Firm* — Rimon P.C.; Tomoki Tanida

(57) ABSTRACT

A medium conveying apparatus includes a first conveying path, a second conveying path that is connected to the first conveying path, a third conveying path that is connected to the first conveying path and the second conveying path, and a skew corrector that blocks a first space between the first conveying path and the second conveying path when a medium conveyed along the first conveying path is skewed, and retreats from the first space when the medium is not skewed, wherein the skew corrector retreats from a second space between the second conveying path and the third conveying path when blocking the first space, and blocks the third space between the first conveying path and the third conveying path when retreating from the first space.

7 Claims, 10 Drawing Sheets

MEDIUM CONVEYING APPARATUS

CROSS-REFERENCE TO RELATED APPLICATION

This application is a continuation of International Application No. PCT/JP2019/011924, filed on Mar. 20, 2019, the entire contents of which are incorporated herein by reference.

FIELD

The embodiments discussed herein are related to a medium conveying apparatus.

BACKGROUND

An image forming apparatus that includes a skew correction mechanism that, when a medium being conveyed is skewed, corrects skew of the medium is known (see Japanese Laid-open Patent Publication No. 2010-143696). Further, a medium conveying apparatus that includes two conveying paths and conveys a medium to any of the conveying paths in accordance with a type of the medium is known. The medium conveying apparatus as described above includes a flap for switching between the conveying paths and is able to appropriately guide a medium to any of the conveying paths.

However, if the medium conveying apparatus separately includes the skew correction mechanism for correcting skew of the medium and the flap for switching between the conveying paths to which the medium is conveyed, a structure becomes complicated and a manufacturing cost may increase.

SUMMARY

According to an aspect of an embodiment, a medium conveying apparatus includes a first conveying path, a second conveying path that is connected to the first conveying path, a third conveying path that is connected to the first conveying path and the second conveying path, and a skew corrector that blocks a space between the first conveying path and the second conveying path when a medium conveyed along the first conveying path is skewed, and retreats from the space between the first conveying path and the second conveying path when the medium is not skewed, wherein the skew corrector retreats from a space between the second conveying path and the third conveying path when blocking the space between the first conveying path and the second conveying path, and blocks the space between the first conveying path and the third conveying path when retreating from the space between the first conveying path and the second conveying path.

The object and advantages of the disclosure will be realized and attained by means of the elements and combinations particularly pointed out in the claims.

It is to be understood that both the foregoing general description and the following detailed description are exemplary and explanatory and are not restrictive of the disclosure.

DESCRIPTION OF EMBODIMENTS

Preferred embodiments of the disclosure will be explained with reference to accompanying drawings. Embodiments of a medium conveying apparatus disclosed in the present application will be described below with reference to the drawings. The technology of the present discloser is not limited by the description below. In addition, in the following description, the same structural elements are denoted by the same reference symbols, and repeated explanation will be omitted.

First Embodiment

Figure 1:
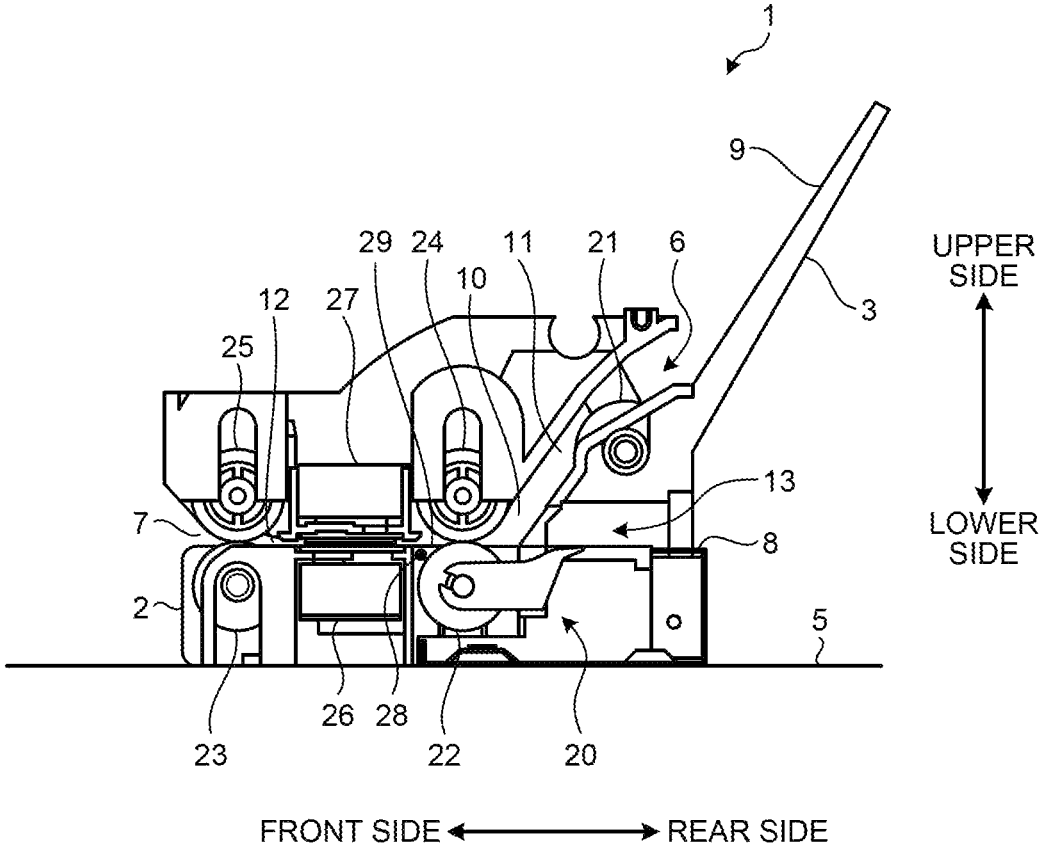
FIG. 1 is a lateral cross-sectional view of an image reading apparatus that includes a medium conveying apparatus of a first embodiment.

As illustrated in FIG. 1, a medium conveying apparatus of a first embodiment is arranged on an image reading apparatus 1. FIG. 1 is a lateral cross-sectional view of the image reading apparatus 1 that includes the medium conveying apparatus of the first embodiment. The image reading apparatus 1 includes an image reading apparatus main body 2 and a feed tray 3. The image reading apparatus main body 2 is placed on an installation surface 5 on which the image reading apparatus 1 is installed. The image reading apparatus main body 2 includes a sheet feed opening 6, an insertion discharge opening 7, and a rear side opening 8. The sheet feed opening 6 is arranged on a rear side of the image reading apparatus 1. The insertion discharge opening 7 is arranged on a front side of the image reading apparatus 1, which is an opposite side of the rear side on which the sheet feed opening 6 is formed. The rear side opening 8 is formed on the rear side of the image reading apparatus 1 such that the rear side opening 8 is located closer to the installation surface 5 than the sheet feed opening 6 and a distance from the installation surface 5 to the rear side opening 8 is equal to a distance from the installation surface 5 to the insertion discharge opening 7.

The feed tray 3 includes a mounting surface 9. The feed tray 3 is arranged on a rear side of the image reading apparatus main body 2 such that the mounting surface 9 is inclined so as to be oriented obliquely upward with respect to a plane that is parallel to the installation surface 5. Further, the feed tray 3 is arranged in the vicinity of the sheet feed opening 6 such that a medium mounted on the mounting surface 9 moves toward the sheet feed opening 6 by gravity, and fixed to the image reading apparatus main body 2.

The image reading apparatus main body 2 further includes conveying paths. The conveying paths are formed inside the image reading apparatus main body 2. The conveying paths include a junction point 10, a medium separation conveying path 11, a medium read conveying path 12, and a medium retraction conveying path 13. The junction point 10 is formed between the insertion discharge opening 7 and the rear side opening 8 such that a distance from the installation surface 5 to the junction point 10 is equal to a distance from the installation surface 5 to one of the insertion discharge opening 7 and the rear side opening 8.

One end of the medium separation conveying path 11 is connected to the sheet feed opening 6. The other end of the medium separation conveying path 11 is connected to the junction point 10. The medium separation conveying path 11 is inclined with respect to a plane parallel to the installation surface 5 such that the other end connected to the junction point 10 is located on a lower side relative to the one end connected to the sheet feed opening 6. The medium read conveying path 12 is formed parallel to a plane that is parallel to the installation surface 5. One end of the medium read conveying path 12 is connected to the junction point 10 and is further connected to the medium separation conveying path 11 via the junction point 10. The other end of the medium read conveying path 12 is connected to the insertion discharge opening 7. One end of the medium retraction conveying path 13 is connected to the rear side opening 8. The other end of the medium retraction conveying path 13 is connected to the junction point 10 and is further connected to the medium separation conveying path 11 and the medium read conveying path 12 via the junction point 10.

The image reading apparatus 1 further includes a conveyor 20. The conveyor 20 includes a separator 21, a first feed roller 22, a second feed roller 23, a first pressure roller 24, and a second pressure roller 25. The separator 21 is formed in the middle of the medium separation conveying path 11. The separator 21 separates a single medium that contacts with the mounting surface 9 of the feed tray 3 from among a plurality of media that are inserted from the sheet feed opening 6 to the medium separation conveying path 11. The separator 21 further conveys the separated single medium toward the junction point 10 along the medium separation conveying path 11.

The first feed roller 22 is formed in a cylindrical shape. The first feed roller 22 is arranged below the medium read conveying path 12, and is rotatably supported by the image reading apparatus main body 2. The first pressure roller 24 is formed in a cylindrical shape. The first pressure roller 24 is arranged above the medium read conveying path 12 in the upper side of the first feed roller 22. The first pressure roller 24 is supported by the image reading apparatus main body 2 so as to be able to perform translational movement in a vertical direction that is perpendicular to a plane parallel to the installation surface 5 and so as to be able to rotate. The first pressure roller 24 presses a medium arranged on the medium read conveying path 12 against the first feed roller 22. The first feed roller 22 rotates in a forward direction (counterclockwise in FIG. 1) and conveys the medium pressed against the first feed roller 22 by the first pressure roller 24 toward the insertion discharge opening 7 along the medium read conveying path 12. The first feed roller 22 rotates in a reverse direction and conveys the medium pressed against the first feed roller 22 by the first pressure roller 24 toward the junction point 10 along the medium read conveying path 12.

The second feed roller 23 is formed in a cylindrical shape. The second feed roller 23 is arranged between the first feed roller 22 located below the medium read conveying path 12 and the insertion discharge opening 7, and is rotatably supported by the image reading apparatus main body 2. The second pressure roller 25 is formed in a cylindrical shape. The second pressure roller 25 is arranged above the medium read conveying path 12 in the upper side of the second feed roller 23. The second pressure roller 25 is supported by the image reading apparatus main body 2 so as to be able to perform translational movement in the vertical direction and so as to be able to rotate. The second pressure roller 25 presses the medium arranged on the medium read conveying path 12 against the second feed roller 23. The second feed roller 23 rotates in the forward direction (counterclockwise in FIG. 1) and conveys the medium pressed against the second feed roller 23 by the second pressure roller 25 toward the insertion discharge opening 7 along the medium read conveying path 12. The second feed roller 23 rotates in the reverse direction and conveys the medium pressed against the second feed roller 23 by the second pressure roller 25 toward the junction point 10 along the medium read conveying path 12.

The image reading apparatus 1 further includes a lower side reader 26 and an upper side reader 27. The lower side reader 26 is formed with an image sensor of a contact image sensor (CIS) type. The lower side reader 26 is arranged between the first feed roller 22 and the second feed roller 23 that are located below the medium read conveying path 12. The lower side reader 26 reads an image on a lower side surface of the medium that is conveyed along the medium read conveying path 12. The upper side reader 27 is formed with an image sensor of a CIS type. The upper side reader 27 is arranged between the first pressure roller 24 and the second pressure roller 25 above the medium read conveying path 12 in the upper side of the lower side reader 26. The upper side reader 27 reads an image on an upper side surface of the medium that is conveyed along the medium read conveying path 12.

The image reading apparatus 1 further includes a medium position detection sensor 28. The medium position detection sensor 28 is arranged between the first feed roller 22 and the lower side reader 26 that are located below the medium read conveying path 12. The medium position detection sensor 28 detects whether a medium is arranged at a medium detection position 29 between the first feed roller 22 and the lower side reader 26 on the medium read conveying path 12.

Figure 2:
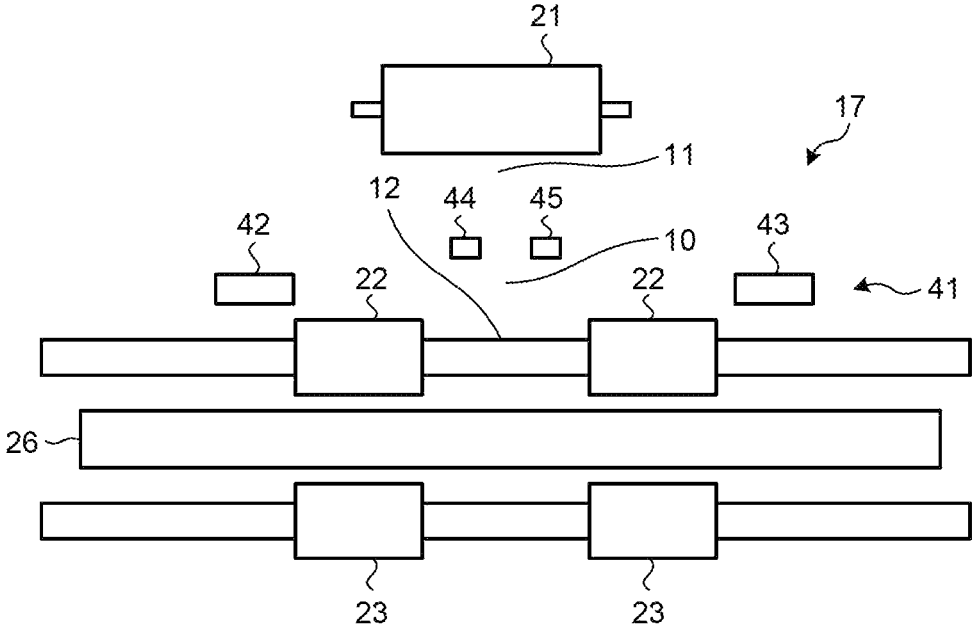
FIG. 2 is a plan view of a skew correction mechanism.

As illustrated in FIG. 2, the image reading apparatus 1 further includes a skew correction mechanism 41. FIG. 2 is a plan view of the skew correction mechanism 41. The skew correction mechanism 41 is arranged in the vicinity of the junction point 10. The skew correction mechanism 41 includes a left stopper 42, a right stopper 43, a left lever 44, and a right lever 45.

Figure 3:
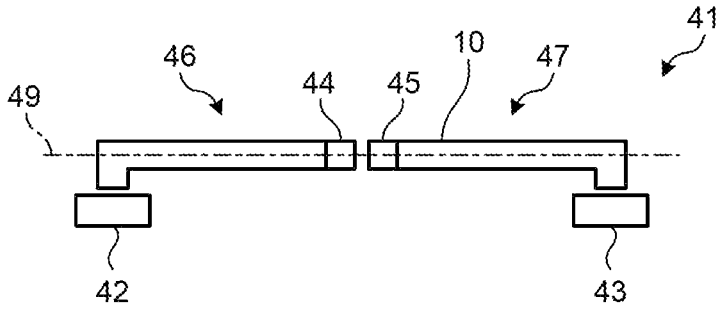
FIG. 3 is a front view of the skew correction mechanism.

FIG. 3 is a front view of the skew correction mechanism 41. The left stopper 42 is arranged on the left side of the junction point 10. The left stopper 42 is supported by the image reading apparatus main body 2 so as to be rotatable about a stopper rotation shaft 48 such that the left stopper 42 is arranged at a left stopper separation conveying path blocking position or a left stopper retraction conveying path blocking position. The stopper rotation shaft 48 is parallel to a rotation shaft of the first feed roller 22. The right stopper 43 is arranged on the right side of the junction point 10. The right stopper 43 is supported by the image reading apparatus main body 2 so as to be rotatable about the stopper rotation shaft 48 such that the right stopper 43 is arranged at a right stopper separation conveying path blocking position or a right stopper retraction conveying path blocking position.

The left lever 44 is arranged between the left stopper 42 and the right stopper 43 at the junction point 10. The left lever 44 is supported by the image reading apparatus main body 2 so as to be rotatable about a lever rotation shaft 49 such that the left lever 44 is arranged at any of a left lever separation conveying path blocking position, a left boundary position, and a left lever retraction conveying path blocking position. The lever rotation shaft 49 is parallel to the stopper rotation shaft 48 and separated from the stopper rotation shaft 48. The right lever 45 is arranged between the left lever 44 and the right stopper 43, i.e., between the left stopper 42 and the right stopper 43, at the junction point 10. The right lever 45 is supported by the image reading apparatus main body 2 so as to be rotatable about the lever rotation shaft 49 such that the right lever 45 is arranged at any of the right lever separation conveying path blocking position, a right boundary position, and the right lever retraction conveying path blocking position.

Figure 4:
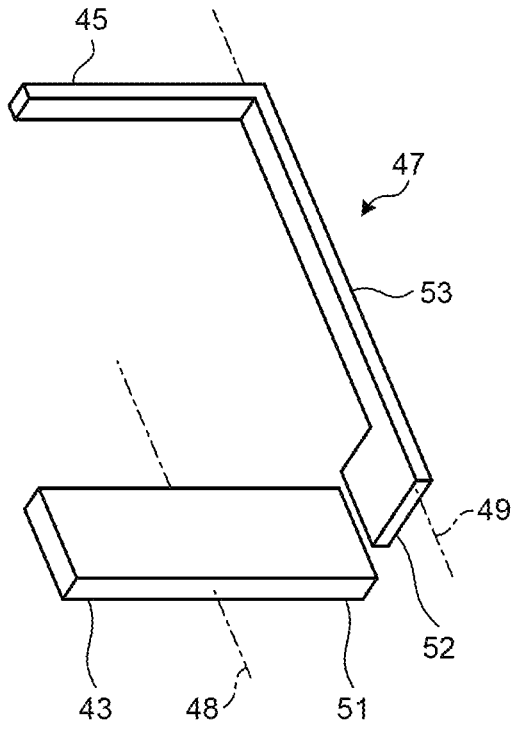
FIG. 4 is a perspective view of a right stopper, a right lever, and a right interlocking mechanism.

The skew correction mechanism 41 further includes a left interlocking mechanism 46 and a right interlocking mechanism 47. FIG. 4 is a perspective view of the right stopper 43, the right lever 45, and the right interlocking mechanism 47. The right stopper 43 is formed in a band shape. The right lever 45 is formed in a bar shape. The right interlocking mechanism 47 includes a lever-side hitting portion 52 and a fixing member 53. The lever-side hitting portion 52 is arranged in the vicinity of a stopper-side hitting portion 51 of the right stopper 43, and fixed to the right lever 45 via the fixing member 53.

Figure 5:
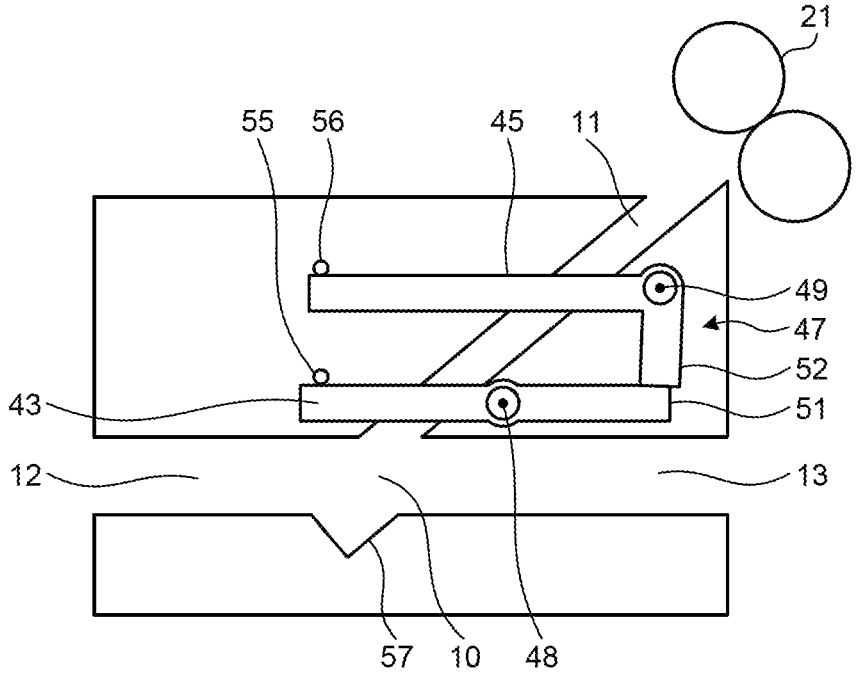
FIG. 5 is a side view of the skew correction mechanism and conveying paths.

FIG. 5 is a side view of the skew correction mechanism 41 and the conveying paths. The stopper rotation shaft 48 and the lever rotation shaft 49 are arranged between the medium separation conveying path 11 and the medium retraction conveying path 13. When the installation surface 5 is parallel to a horizontal plane, the right stopper 43 rotates, by own weight, in a clockwise direction in FIG. 5 toward the right stopper separation conveying path blocking position, and is arranged at the right stopper separation conveying path blocking position. When the installation surface 5 is parallel to a horizontal plane, the right lever 45 rotates, by own weight, in a clockwise direction in FIG. 5 toward the right lever separation conveying path blocking position, and is arranged at the right lever separation conveying path blocking position.

When the right stopper 43 is arranged at the right stopper separation conveying path blocking position, the right stopper 43 is retreated from a space between the junction point 10 and the medium retraction conveying path 13, and blocks a space between the junction point 10 and the medium separation conveying path 11. When the right lever 45 is arranged at the right lever separation conveying path blocking position, the right lever 45 is retreated from the space between the junction point 10 and the medium retraction conveying path 13, and blocks the space between the junction point 10 and the medium separation conveying path 11. When the right lever 45 is arranged at the right lever separation conveying path blocking position, the right lever 45 is arranged at a far side from the junction point 10 relative to the right stopper 43 arranged at the right stopper separation conveying path blocking position.

The right interlocking mechanism 47 is arranged such that when the right lever 45 is arranged at the right lever separation conveying path blocking position, the lever-side hitting portion 52 hits against the stopper-side hitting portion 51 of the right stopper 43 arranged at the right stopper separation conveying path blocking position. By causing the lever-side hitting portion 52 to hit against the stopper-side hitting portion 51, the right interlocking mechanism 47 fixes the right stopper 43 at the right stopper separation conveying path blocking position so as to prevent the right stopper 43 from rotating in a counterclockwise direction from the right stopper separation conveying path blocking position.

The image reading apparatus 1 further includes a stopper contact member 55 and a lever contact member 56. The stopper contact member 55 is arranged so as to contact with the right stopper 43 when the right stopper 43 is arranged at the right stopper separation conveying path blocking position, and fixed to the image reading apparatus main body 2. By contacting with the stopper contact member 55, the right stopper 43 is prevented from rotating in the counterclockwise direction from the right stopper separation conveying path blocking position. The lever contact member 56 is arranged so as to contact with the right lever 45 when the right lever 45 is arranged at the right lever separation conveying path blocking position, and fixed to the image reading apparatus main body 2. By contacting with the lever contact member 56, the right lever 45 is prevented from rotating in the clockwise direction from the right lever separation conveying path blocking position.

Figure 6:
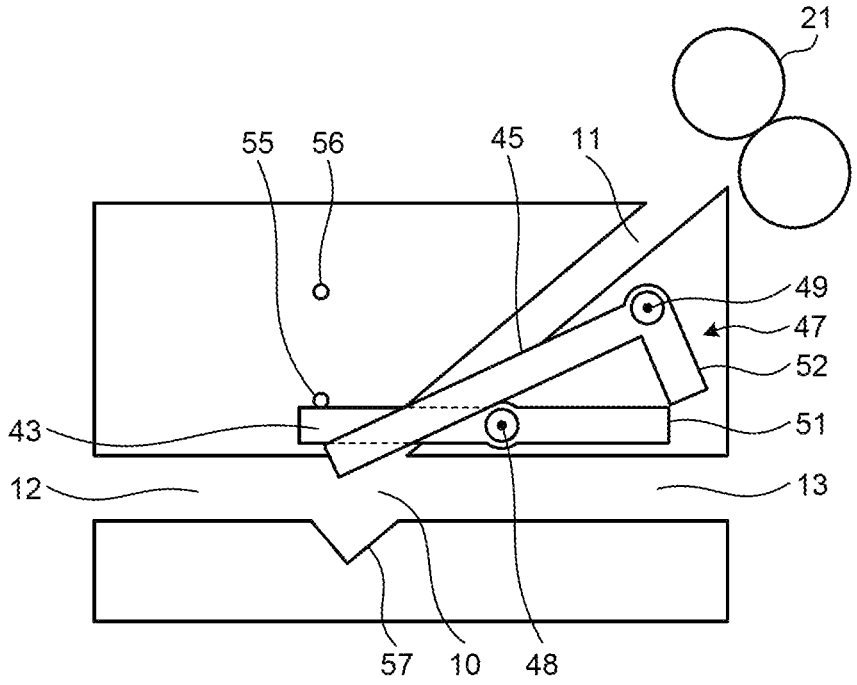
FIG. 6 is a side view of the skew correction mechanism and the conveying paths when the right lever is arranged at a right boundary position.

The right lever 45 moves toward the right boundary position by rotating in the counterclockwise direction about the lever rotation shaft 49 from the right lever separation conveying path blocking position. FIG. 6 is a side view of the skew correction mechanism 41 and the conveying paths when the right lever 45 is arranged at the right boundary position. A blocking position of the medium separation conveying path 11 by the right lever 45 arranged at the right boundary position overlaps with a blocking position of the medium separation conveying path 11 by the right stopper 43 arranged at the right stopper separation conveying path blocking position.

The right interlocking mechanism 47 is arranged such that when the right lever 45 is arranged at the right boundary position, the lever-side hitting portion 52 is prevented from hitting against the stopper-side hitting portion 51. By preventing the lever-side hitting portion 52 from hitting against the stopper-side hitting portion 51 when the right lever 45 is arranged at the right boundary position, the right stopper 43 is released so as to be able to rotate in the counterclockwise direction about the stopper rotation shaft 48 in FIG. 6.

The right interlocking mechanism 47 is arranged such that when the right lever 45 is arranged in a right confinement region between the right boundary position and the right lever separation conveying path blocking position, the lever-side hitting portion 52 hits against the stopper-side hitting portion 51. Therefore, when the right lever 45 is arranged at the right confinement region, the right stopper 43 is confined so as to be arranged at the right stopper separation conveying path blocking position.

Figure 7:
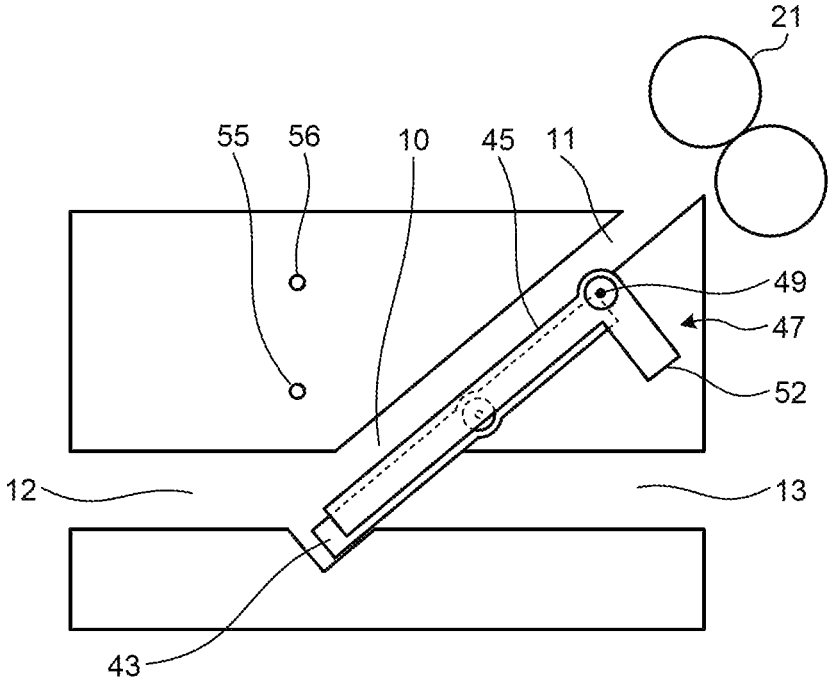
FIG. 7 is a side view of the skew correction mechanism and the conveying paths when the right stopper is arranged at a right stopper retraction conveying path blocking position and the right lever is arranged at the right lever retraction conveying path blocking position.

The right stopper 43 moves toward the right stopper retraction conveying path blocking position by rotating in the counterclockwise direction about the stopper rotation shaft 48 from the right stopper separation conveying path blocking position in FIG. 6. The right lever 45 moves toward the right lever retraction conveying path blocking position by rotating in the counterclockwise direction about the lever rotation shaft 49 from the right boundary position in FIG. 6. FIG. 7 is a side view of the skew correction mechanism 41 and the conveying paths when the right stopper 43 is arranged at the right stopper retraction conveying path blocking position and the right lever 45 is arranged at the right lever retraction conveying path blocking position. When the right stopper 43 is arranged at the right stopper retraction conveying path blocking position, the right stopper 43 is retreated from the space between the junction point 10 and the medium separation conveying path 11, and blocks the space between the junction point 10 and the medium retraction conveying path 13. When the right lever 45 is arranged at the right lever retraction conveying path blocking position, the right lever 45 is retreated from the space between the junction point 10 and the medium separation conveying path 11, and blocks the space between the junction point 10 and the medium retraction conveying path 13.

The right interlocking mechanism 47 is arranged such that when the right lever 45 is arranged in a right release region between the right boundary position and the right lever retraction conveying path blocking position, the lever-side hitting portion 52 is prevented from hitting against the right stopper 43. Therefore, when the right lever 45 is arranged in the right release region, the right interlocking mechanism 47 releases the right stopper 43 such that the right stopper 43 is able to move so as to be arranged at one of the right stopper separation conveying path blocking position and the right stopper retraction conveying path blocking position.

The image reading apparatus 1 further includes a contact member 57. The contact member 57 is arranged below the junction point 10 so as to contact with the right stopper 43 when the right stopper 43 is arranged at the right stopper retraction conveying path blocking position and so as to contact with the right lever 45 when the right lever 45 is arranged at the right lever retraction conveying path blocking position. Meanwhile, the contact member 57 may include a recess in which the right stopper 43 arranged at the right stopper retraction conveying path blocking position and the right lever 45 arranged at the right lever retraction conveying path blocking position are fitted. The contact member 57 is fixed to the image reading apparatus main body 2. By contacting with the contact member 57, the right stopper 43 is prevented from rotating in the counterclockwise direction from the right stopper retraction conveying path blocking position. By contacting with the contact member 57, the right lever 45 is prevented from rotating in the counterclockwise direction from the right lever retraction conveying path blocking position.

The left stopper 42 is formed in the same manner as the right stopper 43. In other words, when the left stopper 42 is arranged at the left stopper separation conveying path blocking position, the left stopper 42 is retreated from the space between the junction point 10 and the medium retraction conveying path 13, blocks the space between the junction point 10 and the medium separation conveying path 11. When the left stopper 42 is arranged at the left stopper retraction conveying path blocking position, the left stopper 42 is retreated from the space between the junction point 10 and the medium separation conveying path 11, and blocks the space between the junction point 10 and the medium retraction conveying path 13. The left stopper 42 contacts with the contact member 57 when being arranged at the left stopper retraction conveying path blocking position, and is prevented from rotating in the counterclockwise direction from the left stopper retraction conveying path blocking position.

The left lever 44 is formed in the same manner as the right lever 45. In other words, when the left lever 44 is arranged at the left lever separation conveying path blocking position, the left lever 44 is retreated from the space between the junction point 10 and the medium retraction conveying path 13, and blocks the space between the junction point 10 and the medium separation conveying path 11. When the left lever 44 is arranged at the left lever retraction conveying path blocking position, the left lever 44 is retreated from the space between the junction point 10 and the medium separation conveying path 11, and blocks the space between the junction point 10 and the medium retraction conveying path 13. The left lever 44 contacts with the contact member 57 when being arranged at the left lever retraction conveying path blocking position, and is prevented from rotating in the counterclockwise direction from the left lever retraction conveying path blocking position.

The left interlocking mechanism 46 is formed in the same manner as the right interlocking mechanism 47. In other words, when the left lever 44 is arranged in a left confinement region, the left interlocking mechanism 46 confines the left stopper 42 in a state in which the left stopper 42 is arranged at the left stopper separation conveying path blocking position. When the left lever 44 is arranged in a left release region, the left interlocking mechanism 46 allows the left stopper 42 to move such that the left stopper 42 is arranged at the left stopper retraction conveying path blocking position. A blocking position of the medium separation conveying path 11 by the left lever 44 arranged at the left boundary position overlaps with a blocking position of the medium separation conveying path 11 by the left stopper 42 arranged at the left stopper separation conveying path blocking position. A blocking position of the medium separation conveying path 11 by the left stopper 42 arranged at the left stopper separation conveying path blocking position overlaps with a blocking position of the medium separation conveying path 11 by the right stopper 43 arranged at the right stopper separation conveying path blocking position.

Figure 8:
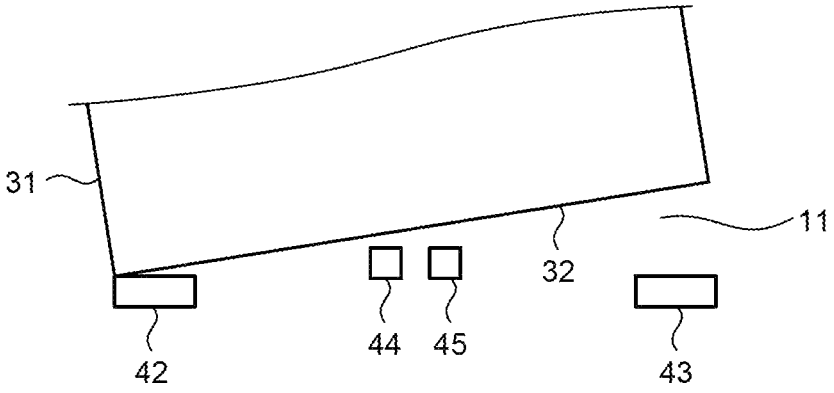
FIG. 8 is a plan view of a medium that passes through the skew correction mechanism.

As illustrated in FIG. 8, a single medium 31 separated by the separator 21 may be conveyed along the medium separation conveying path 11 in a skewed manner with respect to the medium separation conveying path 11. FIG. 8 is a plan view of the medium 31 that passes through the skew correction mechanism 41. When the medium 31 in a skewed state passes through the skew correction mechanism 41, a leading end 32 of the medium 31 may hit against the left stopper 42 of the skew correction mechanism 41 without hitting against the right stopper 43 of the skew correction mechanism 41. After the leading end 32 hits against the left stopper 42, the medium 31 is further conveyed by the separator 21, bent, and rotates substantially about the left stopper 42 such that the leading end 32 of the medium 31 approaches the right stopper 43.

Figure 9:
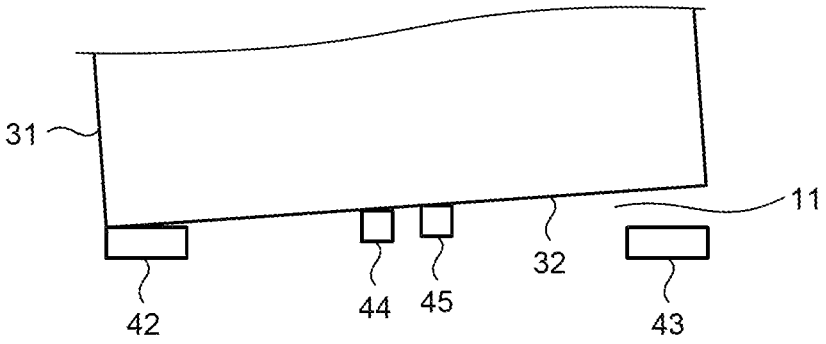
FIG. 9 is a plan view of the medium that hits against both of a left lever and the right lever of the skew correction mechanism.

As illustrated in FIG. 9, the leading end 32 further hits against both of the left lever 44 and the right lever 45 due to the rotation of the medium 31. FIG. 9 is a plan view of the medium 31 that hits against both of the left lever 44 and the right lever 45 of the skew correction mechanism 41. Due to the hitting of the medium 31 against the left lever 44, the left lever 44 rotates from the left lever separation conveying path blocking position toward the left boundary position. Due to the hitting of the medium 31 against the right lever 45, the right lever 45 rotates from the right lever separation conveying path blocking position toward the right boundary position.

Figure 10:
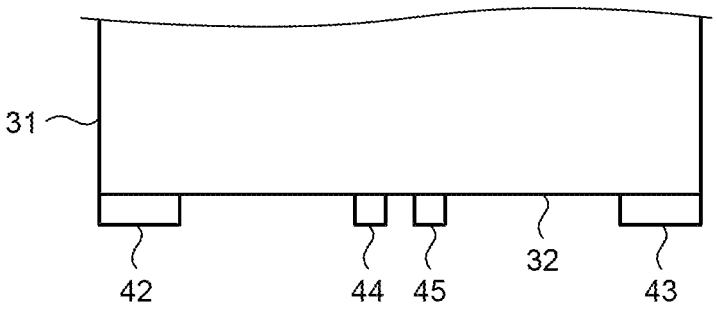
FIG. 10 is a plan view of the medium that hits against both of a left stopper and the right stopper of the skew correction mechanism.

After the leading end 32 hits against both of the left lever 44 and the right lever 45, the medium 31 is further conveyed by the separator 21 and further rotates. Due to the further rotation of the medium 31, the leading end 32 hits against both of the left stopper 42 and the right stopper 43 as illustrated in FIG. 10. FIG. 10 is a plan view of the medium 31 that hits against both of the left stopper 42 and the right stopper 43 of the skew correction mechanism 41. The medium 31 is not skewed with respect to the medium separation conveying path 11 when hitting against both of the left stopper 42 and the right stopper 43, and is arranged such that skew is corrected and a straight line along the leading end 32 is parallel to the rotation shaft of the first feed roller 22. When the leading end 32 of the medium 31 hits against both of the left stopper 42 and the right stopper 43, the left lever 44 is pushed by the leading end 32 and arranged at the left boundary position. Due to the arrangement of the left lever 44 at the left boundary position, the left interlocking mechanism 46 releases the left stopper 42 such that the left stopper 42 rotates toward the left stopper retraction conveying path blocking position. When the leading end 32 of the medium 31 hits against both of the left stopper 42 and the right stopper 43, the right lever 45 is pushed by the leading end 32 and arranged at the right boundary position. Due to the arrangement of the right lever 45 at the right boundary position, the right interlocking mechanism 47 releases the right stopper 43 such that the right stopper 43 rotates toward the right stopper retraction conveying path blocking position.

Due to the release of the left stopper 42 and the right stopper 43, the separator 21 is able to feed the medium 31, which is to be conveyed toward the junction point 10, to the junction point 10. When being released, the left stopper 42 rotates by being pushed by the medium 31 being fed to the junction point 10, and is arranged at the left stopper retraction conveying path blocking position. When being released, the right stopper 43 rotates by being pushed by the medium 31 being fed to the junction point 10, and is arranged at the right stopper retraction conveying path blocking position. The left lever 44 rotates by being pushed by the medium 31 being fed to the junction point 10, and is arranged at the left lever retraction conveying path blocking position. The right lever 45 rotates by being pushed by the medium 31 being fed to the junction point 10, and is arranged at the right lever retraction conveying path blocking position. Therefore, the space between the junction point 10 and the medium retraction conveying path 13 is blocked by the left stopper 42, the right stopper 43, the left lever 44, and the right lever 45.

Due to the block of the space between the junction point 10 and the medium retraction conveying path 13, the medium 31 fed to the junction point 10 is prevented from entering the medium retraction conveying path 13. Therefore, the medium 31 fed to the junction point 10 is fed to the medium read conveying path 12 in a state in which a straight line along the leading end 32 is parallel to the rotation shaft of the first feed roller 22, that is, the skew is corrected. The skew correction mechanism 41 is able to correct skew of the medium 31 in the same manner when the medium 31 hits against the right stopper 43 before hitting against the left stopper 42.

The image reading apparatus 1 may convey a medium with a small width with which the medium hits against only one of the left stopper 42 and the right stopper 43, unlike a printer. In the image reading apparatus 1, even if the medium hits against only one of the left stopper 42 and the right stopper 43, the medium hits against both of the left lever 44 and the right lever 45, so that it is possible to release the left stopper 42 and the right stopper 43. Therefore, the image reading apparatus 1 is able to appropriately correct skew of a medium.

Figure 11:
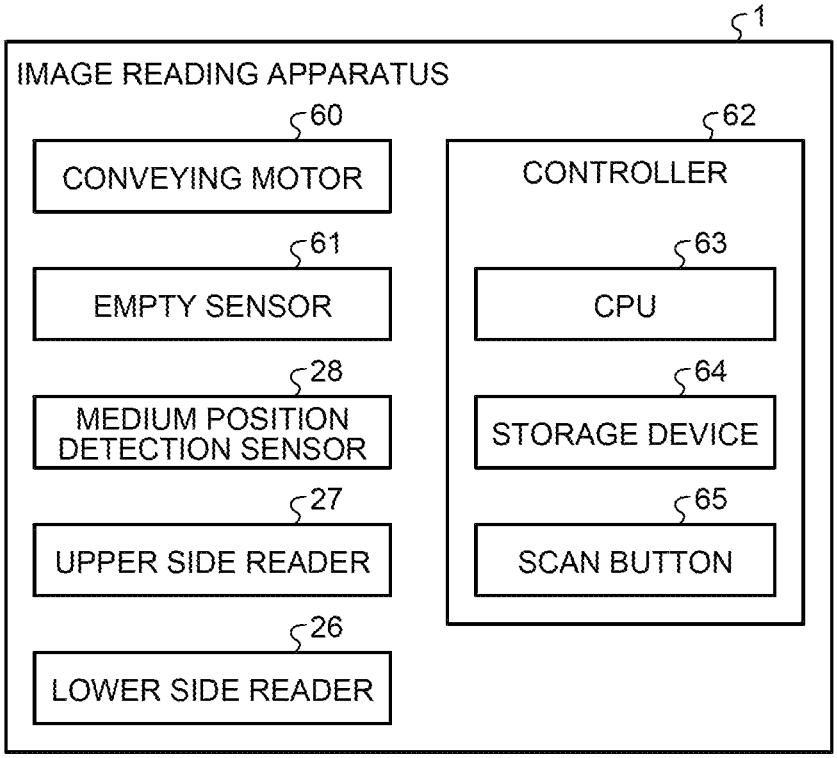
FIG. 11 is a block diagram of an image reading apparatus.

FIG. 11 is a block diagram of the image reading apparatus 1. The image reading apparatus 1 further includes a conveying motor 60, an empty sensor 61, and a controller 62. The conveying motor 60 causes the first feed roller 22 and the second feed roller 23 to rotate in the forward direction or the reverse direction under the control of the controller 62. The empty sensor 61 detects whether a medium is placed on the feed tray 3 under the control of the controller 62.

The controller 62 is a computer and includes a central processing unit (CPU) 63, a storage device 64, and a scan button 65. The CPU 63, by executing a computer program installed in the controller 62, performs information processing and controls the storage device 64 and the scan button 65. The storage device 64 records the computer program and records information used by the CPU 63. As the storage device 64, for example, a memory, such as a random access memory (RAM) or a read only memory (ROM), a fixed disk device, such as a hard disk, a solid state drive, and/or an optical disk may be used. The scan button 65 detects whether the scan button 65 is pressed, and outputs a detection result to the CPU 63.

The controller 62 further controls the conveying motor 60, the empty sensor 61, the medium position detection sensor 28, the lower side reader 26, and the upper side reader 27 by executing the computer program. For example, the controller 62 controls the empty sensor 61 to detect whether a medium is placed on the feed tray 3. The controller 62 controls the conveying motor 60 to rotate the first feed roller 22 and the second feed roller 23 in the forward direction or the reverse direction. The controller 62 controls the medium position detection sensor 28 to detect timings at which a leading end and a trailing end of a medium conveyed along the medium read conveying path 12 pass through the medium detection position 29 when the first feed roller 22 and the second feed roller 23 rotate in the reverse direction. The controller 62 controls the lower side reader 26 and the upper side reader 27 to read images on both side surfaces of a medium that is conveyed along the medium read conveying path 12.

Figure 12:
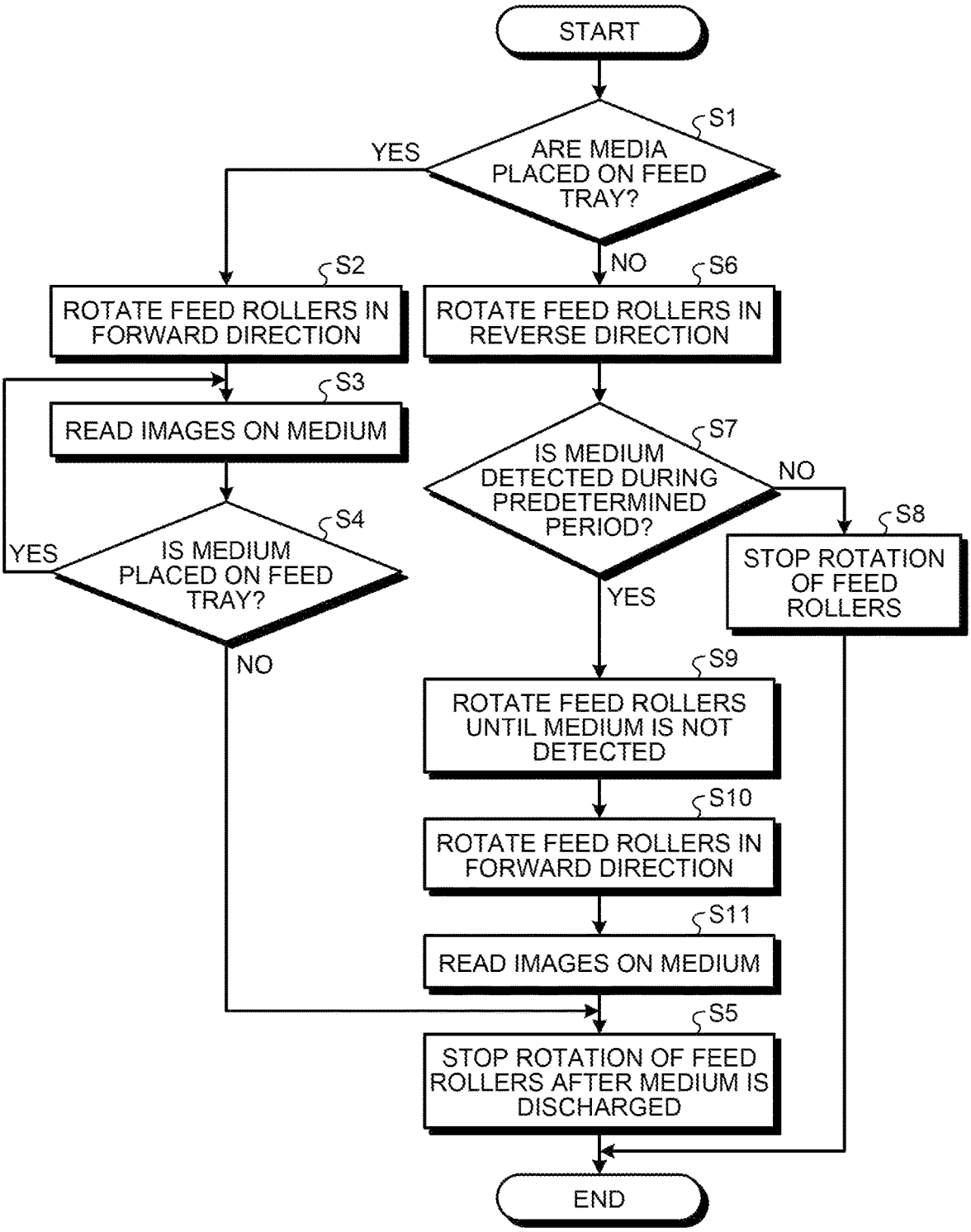
FIG. 12 is a flowchart illustrating operation of the image reading apparatus.

Operation of image reading apparatus 1 FIG. 12 is a flowchart illustrating operation of the image reading apparatus 1. When a user wants to read images on a plurality of thin media using the image reading apparatus 1, the user places the thin media on the feed tray 3 and thereafter presses the scan button 65. Each of the thin media is a single medium formed of a shingle sheet of paper, and the thin media are not bound and are separable. The thin media are inserted in the sheet feed opening 6 by gravity when being placed on the feed tray 3, and contact with the separator 21. When the user wants to read an image on a thick medium using the image reading apparatus 1, the user inserts the thick medium into the insertion discharge opening 7 such that the thick medium is sandwiched between the second feed roller 23 and the second pressure roller 25, and thereafter presses the scan button 65. Examples of the thick medium include a plastic card and a booklet that is formed by binding the thin media.

When the image reading apparatus 1 is activated, the controller 62 detects whether the scan button 65 is pressed by controlling the scan button 65. If it is detected that the scan button 65 is pressed, the controller 62 controls the empty sensor 61 to detect whether media are placed on the feed tray 3 (Step S1). If it is detected that the media are placed on the feed tray 3 (Step S1, Yes), the controller 62 controls the conveying motor 60 to rotate the first feed roller 22 and the second feed roller 23 in the forward direction (Step S2).

With the forward rotation of the first feed roller 22 and the second feed roller 23, the separator 21 separates, from the plurality of thin media, a single thin medium in contact with the mounting surface 9 among the plurality of thin media placed on the feed tray 3. Further, the separator 21 conveys the separated thin medium toward the junction point 10 along the medium separation conveying path 11.

The skew correction mechanism 41 corrects skew of the thin medium that is conveyed by the separator 21 toward the junction point 10 along the medium separation conveying path 11. The thin medium for which the skew is corrected by the skew correction mechanism 41 is further conveyed by the separator 21 toward the junction point 10, and fed to the junction point 10. When the thin medium is fed to the junction point 10, the space between the junction point 10 and the medium retraction conveying path 13 is blocked by the left stopper 42, the right stopper 43, the left lever 44, and the right lever 45. By blocking the space between the junction point 10 and the medium retraction conveying path 13, the image reading apparatus 1 prevents the thin medium from entering the medium retraction conveying path 13 from the medium separation conveying path 11 via the junction point 10, so that it is possible to appropriately feed the thin medium to the medium read conveying path 12.

The thin medium fed to the medium read conveying path 12 is conveyed along the medium read conveying path 12, and sandwiched between the first feed roller 22 and the first pressure roller 24. When the thin medium is sandwiched between the first feed roller 22 and the first pressure roller 24, the first pressure roller 24 presses the sandwiched thin medium against the first feed roller 22. The first feed roller 22 rotates in the forward direction, and conveys the thin medium pressed against the first feed roller 22 by the first pressure roller 24 toward the insertion discharge opening 7 along the medium read conveying path 12.

The thin medium conveyed by the first feed roller 22 toward the insertion discharge opening 7 along the medium read conveying path 12 passes through the medium detection position 29, and thereafter is conveyed between the lower side reader 26 and the upper side reader 27. While the first feed roller 22 and the second feed roller 23 rotate in the forward direction, the controller 62 controls the medium position detection sensor 28 to detect a leading end passage timing at which a leading end of the thin medium passes through the medium detection position 29 and a trailing end passage timing at which a trailing end of the thin medium passes through the medium detection position 29. During a read period that is calculated based on the detected leading end passage timing and the trailing end passage timing, the controller 62 controls the lower side reader 26 and the upper side reader 27 to read images on the both side surfaces of the thin medium (Step S3). The thin medium that is conveyed by the first feed roller 22 toward the insertion discharge opening 7 passes through between the lower side reader 26 and the upper side reader 27, and thereafter is sandwiched between the second feed roller 23 and the second pressure roller 25.

When the thin medium is sandwiched between the second feed roller 23 and the second pressure roller 25, the second pressure roller 25 presses the sandwiched thin medium against the second feed roller 23. The second feed roller 23, by rotating in the forward direction, conveys the thin medium pressed against the second feed roller 23 by the second pressure roller 25 toward the insertion discharge opening 7 along the medium read conveying path 12, and discharges the thin medium from the insertion discharge opening 7.

While it is detected that a medium is placed on the feed tray 3 (Step S4, Yes), the controller 62 repeats the process at Step S3, and reads images on both side surfaces of all of the thin media. If it is detected that a medium is not placed on the feed tray 3 (Step S4, No), the controller 62 waits until the thin media from which the images are read are discharged via the insertion discharge opening 7. After the thin media from which the images are read are discharged via the insertion discharge opening 7, the controller 62 controls the conveying motor 60 to stop rotation of the first feed roller 22 and the second feed roller 23 (Step S5).

If it is detected that a medium is not placed on the feed tray 3 (Step S1, No), the controller 62 controls the conveying motor 60 to rotate the first feed roller 22 and the second feed roller 23 in the reverse direction (Step S6). When a thick medium is sandwiched between the second feed roller 23 and the second pressure roller 25, the second pressure roller 25 presses the sandwiched thick medium against the second feed roller 23. The second feed roller 23, by rotating in the reverse direction, conveys the thick medium pressed against the second feed roller 23 by the second pressure roller 25 toward the medium read conveying path 12.

During a predetermined period since start of rotation of the first feed roller 22 and the second feed roller 23 in the reverse direction, the controller 62 controls the medium position detection sensor 28 to detect whether a leading end of the thick medium has passed through the medium detection position 29 (Step S7). If it is not detected that the leading end of the thick medium has passed through the medium detection position 29 during the predetermined period (Step S7, No), the controller 62 controls the conveying motor 60 to stop rotation of the first feed roller 22 and the second feed roller 23 (Step S8). Through the processes at Step S7 and Step S8, when the thick medium is not appropriately conveyed along the medium read conveying path 12, the image reading apparatus 1 is able to prevent the first feed roller 22 and the second feed roller 23 from continuously rotating in the reverse direction.

Figure 13:
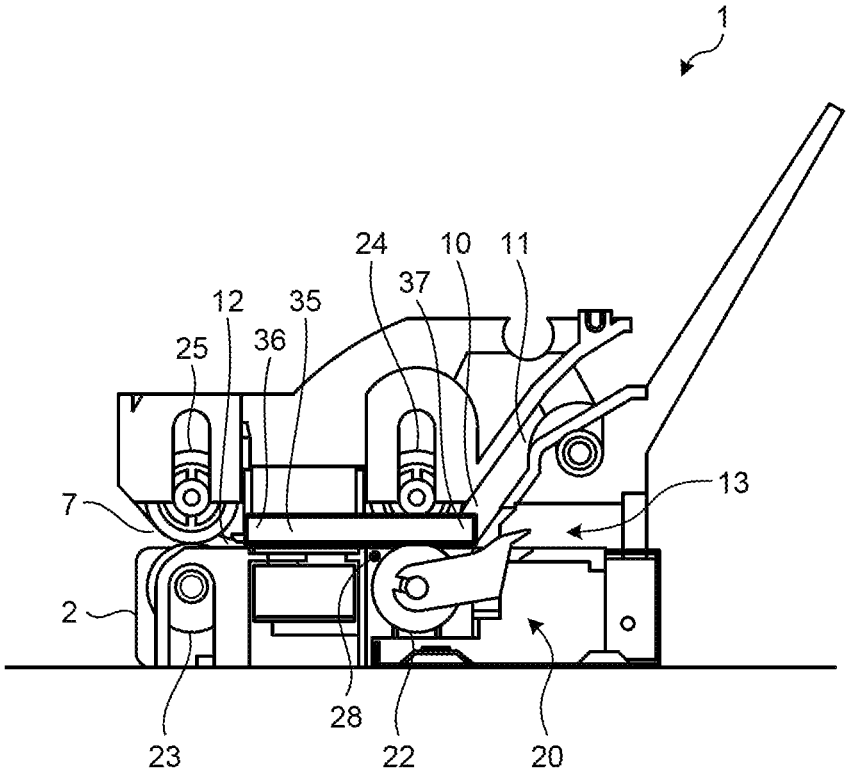
FIG. 13 is a lateral cross-sectional view of a thick medium fed from a medium read conveying path to a junction point.

If it is detected that the leading end of the thick medium has passed through the medium detection position 29 (Step S7, Yes), the controller 62 controls the first feed roller 22 and the second feed roller 23 to rotate in the reverse direction until a trailing end of the thick medium is detected at the medium detection position 29 (Step S9). In other words, the thick medium conveyed by the second feed roller 23 toward the junction point 10 along the medium read conveying path 12 passes through the medium detection position 29, and thereafter is sandwiched between the first feed roller 22 and the first pressure roller 24. When the thick medium is sandwiched between the first feed roller 22 and the first pressure roller 24, the first pressure roller 24 presses the sandwiched thick medium against the first feed roller 22. The first feed roller 22, by rotating in the reverse direction, conveys the thick medium pressed against the first feed roller 22 by the first pressure roller 24 toward the junction point 10 along the medium read conveying path 12, and feeds the thick medium to the junction point 10. FIG. 13 is a lateral cross-sectional view of a thick medium 35 fed from the medium read conveying path 12 to the junction point 10.

Figure 14:
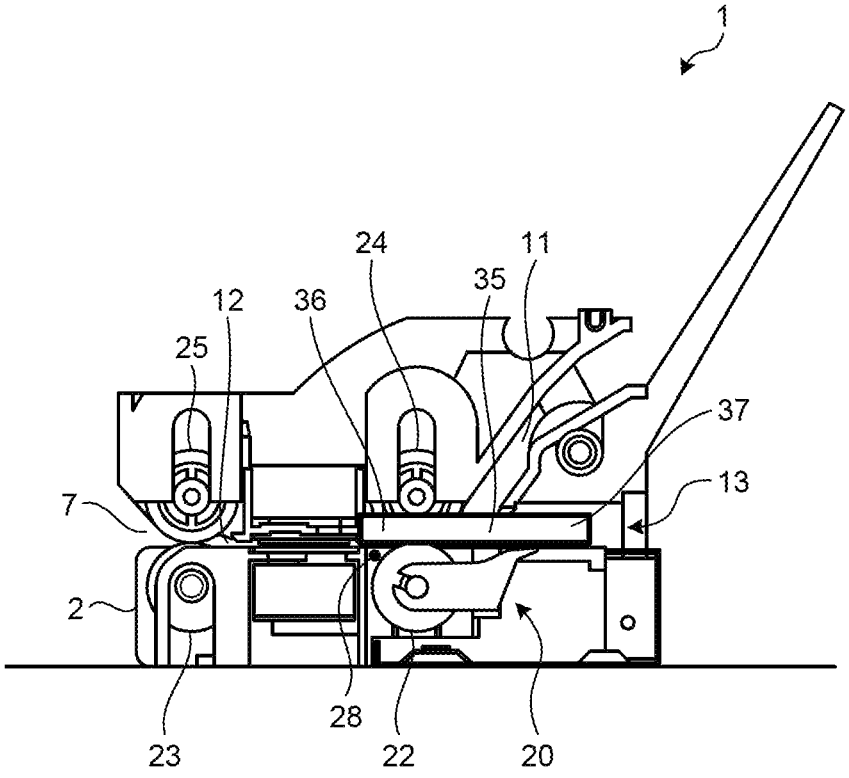
FIG. 14 is a lateral cross-sectional view of the thick medium fed from the medium read conveying path to a medium retraction conveying path via the junction point.

The thick medium 35 fed from the medium read conveying path 12 to the junction point 10 is conveyed by the first feed roller 22 toward the junction point 10 along the medium read conveying path 12, and fed to the medium retraction conveying path 13 as illustrated in FIG. 14. FIG. 14 is a lateral cross-sectional view of the thick medium 35 fed from the medium read conveying path 12 to the medium retraction conveying path 13 via the junction point 10.

The space between the junction point 10 and the medium separation conveying path 11 is initially blocked by the left stopper 42, the right stopper 43, the left lever 44, and the right lever 45. The image reading apparatus 1 is able to prevent the thick medium 35 from entering the medium separation conveying path 11 from the medium read conveying path 12 via the junction point 10 by blocking the space between the junction point 10 and the medium separation conveying path 11. The image reading apparatus 1 is able to appropriately feed the thick medium 35 to the medium retraction conveying path 13 by preventing the thick medium 35 from entering the medium separation conveying path 11 from the medium read conveying path 12 via the junction point 10.

Figure 15:
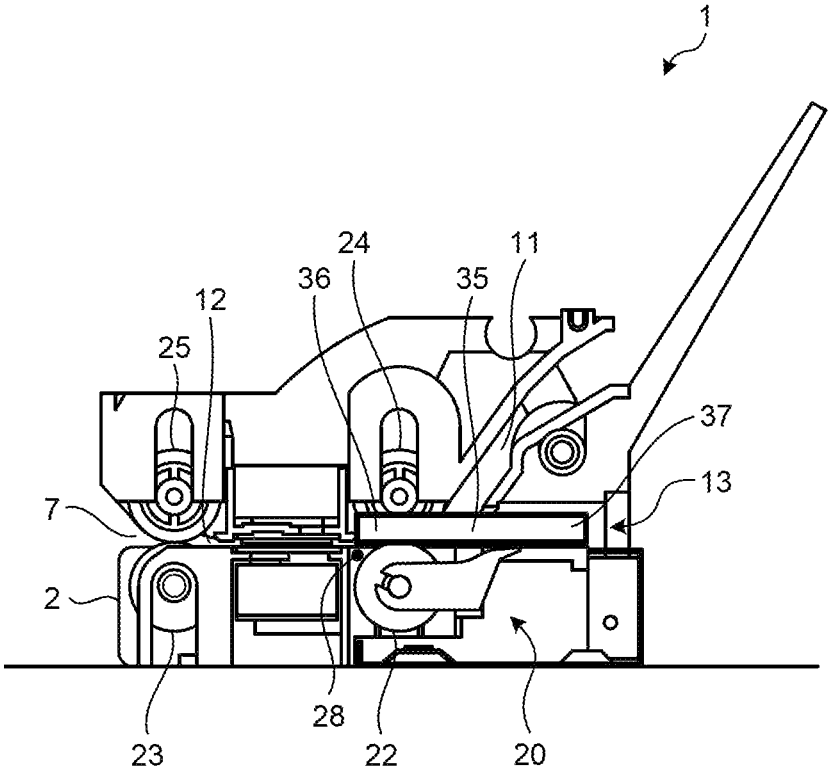
FIG. 15 is a lateral cross-sectional view of the thick medium, a trailing end of which has passed through a medium detection position.

The thick medium 35 fed to the medium retraction conveying path 13 is conveyed by the first feed roller 22 along the medium retraction conveying path 13, so that a trailing end 36 of the thick medium 35 is separated from the second feed roller 23 and the second pressure roller 25. The thick medium 35 is further conveyed by the first feed roller 22 toward the junction point 10, so that the trailing end 36 of the thick medium 35 passes through the medium detection position 29 as illustrated in FIG. 15. FIG. 15 is a lateral cross-sectional view of the thick medium 35, the trailing end 36 of which has passed through the medium detection position 29. The controller 62 controls the medium position detection sensor 28 to detect a trailing end passage timing at which the trailing end 36 of the thick medium 35 has passed through the medium detection position 29. The controller 62 controls the conveying motor 60 to stop rotation of the first feed roller 22 and the second feed roller 23 immediately after the detected trailing end passage timing. Due to the stop of the rotation of the first feed roller 22 and the second feed roller 23 immediately after the trailing end passage timing, the thick medium 35 is stopped in the state of being sandwiched between the first feed roller 22 and the first pressure roller 24.

After the rotation of the first feed roller 22 and the second feed roller 23 is stopped, the controller 62 controls the conveying motor 60 to rotate the first feed roller 22 and the second feed roller 23 in the forward direction (Step S10). With the rotation of the first feed roller 22 and the second feed roller 23 in the forward direction, the thick medium 35 is conveyed toward the insertion discharge opening 7 along the medium read conveying path 12. While the first feed roller 22 and the second feed roller 23 are rotating in the forward direction, the controller 62 controls the medium position detection sensor 28 to detect the trailing end passage timing at which the trailing end 36 of the thick medium 35 passes through the medium detection position 29 and a leading end passage timing at which a leading end 37 of the thick medium 35 passes through the medium detection position 29.

The thick medium 35 that is conveyed by the first feed roller 22 toward the insertion discharge opening 7 along the medium read conveying path 12 is conveyed through a space between the lower side reader 26 and the upper side reader 27 after the trailing end 36 has passed through the medium detection position 29. During a read period that is calculated based on the detected leading end passage timing and the detected trailing end passage timing, the controller 62 controls the lower side reader 26 and the upper side reader 27 to reads images on both side surfaces of the thick medium 35 (Step S11).

The thick medium 35 that is conveyed by the first feed roller 22 toward the insertion discharge opening 7 passes through the space between the lower side reader 26 and the upper side reader 27, and thereafter is sandwiched between the second feed roller 23 and the second pressure roller 25. When the thick medium 35 is sandwiched between the second feed roller 23 and the second pressure roller 25, the second pressure roller 25 presses the sandwiched thick medium 35 against the second feed roller 23. The second feed roller 23, by rotating in the forward direction, conveys the thick medium 35 pressed against the second feed roller 23 by the second pressure roller 25 toward the insertion discharge opening 7 along the medium read conveying path 12, and discharges the thick medium 35 from the insertion discharge opening 7. After the thick medium 35 is discharged via the insertion discharge opening 7, the controller 62 controls the conveying motor 60 to stop rotation of the first feed roller 22 and the second feed roller 23 (Step S5).

Effects of Medium Conveying Apparatus of First Embodiment

The medium conveying apparatus of the first embodiment includes the medium separation conveying path 11, the medium read conveying path 12, the medium retraction conveying path 13, and the right stopper 43. The medium read conveying path 12 is connected to the medium separation conveying path 11. The medium retraction conveying path 13 is connected to the medium separation conveying path 11 and the medium read conveying path 12. The right stopper 43 blocks the space between the medium separation conveying path 11 and the medium read conveying path 12 when the medium conveyed along the medium separation conveying path 11 is skewed, and retreats from the space between the medium separation conveying path 11 and the medium read conveying path 12 when the medium is not skewed. The right stopper 43 retreats from the space between the medium read conveying path 12 and the medium retraction conveying path 13 when blocking the space between the medium separation conveying path 11 and the medium read conveying path 12, and blocks the space between the medium separation conveying path 11 and the medium retraction conveying path 13 when retreating from the space between the medium separation conveying path 11 and the medium read conveying path 12. In this case, the medium conveying apparatus of the first embodiment need not include a switching unit that opens and closes the space between the medium read conveying path 12 and the medium retraction conveying path 13 separately from the right stopper 43, so that it is possible to reduce the number of components and a manufacturing cost.

Furthermore, the medium conveying apparatus of the first embodiment further includes the conveyor 20. The conveyor 20 conveys a medium from the medium read conveying path 12 to the medium retraction conveying path 13 or from the medium retraction conveying path 13 to the medium read conveying path 12 when the right stopper 43 is retreated from the space between the medium read conveying path 12 and the medium retraction conveying path 13. The conveyor 20 conveys a medium from the medium separation conveying path 11 to the medium read conveying path 12 when the right stopper 43 is retreated from the space between the medium separation conveying path 11 and the medium read conveying path 12. In this case, the medium conveying apparatus of the first embodiment is able to prevent the medium from entering the medium retraction conveying path 13 when the medium is conveyed from the medium separation conveying path 11 to the medium read conveying path 12. The medium conveying apparatus of the first embodiment is able to prevent the medium from entering the medium separation conveying path 11 when the medium is conveyed from the medium read conveying path 12 to the medium retraction conveying path 13 or from the medium retraction conveying path 13 to the medium read conveying path 12.

Moreover, the right stopper 43 of the medium conveying apparatus of the first embodiment is supported by the image reading apparatus main body 2 so as to be able to rotate about the stopper rotation shaft 48. The stopper rotation shaft 48 is arranged between the medium separation conveying path 11 and the medium retraction conveying path 13. In this case, the medium conveying apparatus of the first embodiment is able to appropriately move the right stopper 43 such that the right stopper 43 blocks a predetermined portion in the conveying path and such that the right stopper 43 retreats from a predetermined region.

Furthermore, the medium conveying apparatus of the first embodiment further includes the contact member 57. The contact member 57 is arranged so as to be separated from the right stopper 43 when the right stopper 43 is retreated from the space between the medium read conveying path 12 and the medium retraction conveying path 13 and so as to contact with the right stopper 43 when the right stopper 43 blocks the space between the medium separation conveying path 11 and the medium retraction conveying path 13, and is fixed to the image reading apparatus main body 2.

In this case, the medium conveying apparatus of the first embodiment is able to prevent the right stopper 43 from being moved to a different position due to an external force when the right stopper 43 blocks the space between the medium separation conveying path 11 and the medium retraction conveying path 13. Therefore, the medium conveying apparatus of the first embodiment is reliably prevent the medium from entering the medium retraction conveying path 13 when the right stopper 43 blocks the space between the medium separation conveying path 11 and the medium retraction conveying path 13.

Moreover, the medium conveying apparatus of the first embodiment further includes the right lever 45 and the right interlocking mechanism 47. The right lever 45 is rotatably supported by the image reading apparatus main body 2 so as to be arranged in the right confinement region or the right release region. The right interlocking mechanism 47 confines the right stopper 43 such that when the right lever 45 is arranged in the right confinement region, the right stopper 43 blocks the space between the medium separation conveying path 11 and the medium read conveying path 12, and allows the right stopper 43 to move such that when the right lever 45 is arranged in the right release region, the right stopper 43 blocks the space between the medium read conveying path 12 and the medium retraction conveying path 13. The right lever 45 moves from the right confinement region to the right release region by contacting with the medium that is conveyed from the medium separation conveying path 11 to the medium read conveying path 12, and moves from the right release region to the right confinement region by being separated from the medium. In this case, the skew correction mechanism 41 of the medium conveying apparatus of the first embodiment includes the right stopper 43, the right lever 45, and the right interlocking mechanism 47, so that it is possible to appropriately correct the skew of the medium.

Furthermore, the right lever 45 of the medium conveying apparatus of the first embodiment blocks the space between the medium separation conveying path 11 and the medium retraction conveying path 13 when the right stopper 43 blocks the space between the medium separation conveying path 11 and the medium retraction conveying path 13. In this case, the medium conveying apparatus of the first embodiment is able to reliably prevent the medium from entering the medium retraction conveying path 13.

Meanwhile, while the right lever 45 of the medium conveying apparatus of the first embodiment blocks the space between the medium separation conveying path 11 and the medium retraction conveying path 13 when being arranged at the right lever retraction conveying path blocking position, the right lever 45 may be configured not to block the space between the medium separation conveying path 11 and the medium retraction conveying path 13. Even if the right lever 45 does not block the medium retraction conveying path 13, the medium conveying apparatus is able to appropriately switch between the conveying paths in which the medium is conveyed because the right stopper 43 blocks the medium retraction conveying path 13. Therefore, even in the medium conveying apparatus as described above, the skew correction mechanism 41 that corrects skew of a medium may also be used as a guide for switching between the conveying paths in which the medium is conveyed, so that it is possible to reduce a manufacturing cost by simplifying the structure.

Meanwhile, while the right stopper 43 is configured to move to the right stopper separation conveying path blocking position by own weight, the skew correction mechanism 41 may further include a biasing unit that moves the right stopper 43 to the right stopper separation conveying path blocking position when the right stopper 43 is not in contact with a medium. Examples of the biasing unit include an elastic body that applies an elastic force to the right stopper 43 such that the right stopper 43 moves to the right stopper separation conveying path blocking position. Furthermore, while the left lever 44 is configured to move to the left lever conveying path blocking position by own weight, the skew correction mechanism 41 may further include a biasing unit that moves the left lever 44 to the left lever conveying path blocking position when the left lever 44 is not in contact with a medium. Examples of the biasing unit include an elastic body that applies an elastic force to the left lever 44 such that the left lever 44 moves to the left lever conveying path blocking position. Even if the biasing units as described above are arranged, the medium conveying apparatus is able to further use the skew correction mechanism, which corrects skew of a medium, as a guide for switching between the conveying paths in which the medium is conveyed, so that it is possible to reduce a manufacturing cost by simplifying the structure.

Second Embodiment

Figure 16:
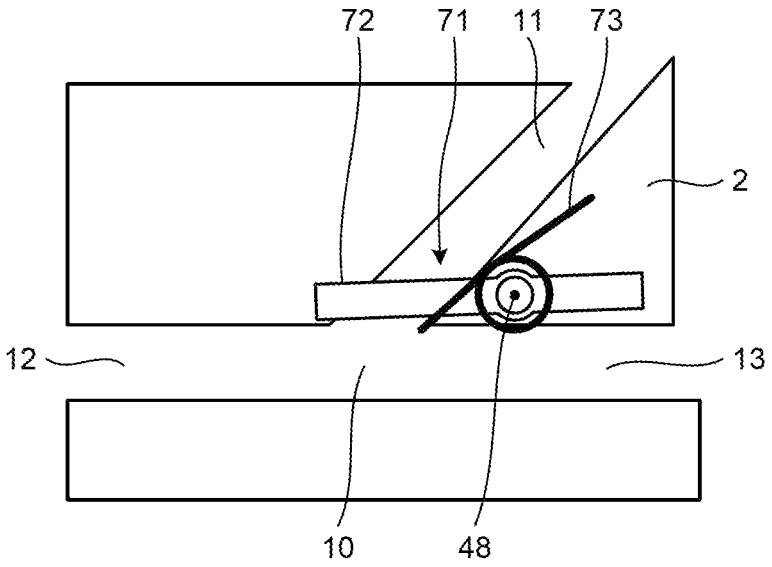
FIG. 16 is a side view of a skew correction mechanism and conveying paths of a medium conveying apparatus of a second embodiment.

As illustrated in FIG. 16, in a medium conveying apparatus of a second embodiment, the skew correction mechanism 41 of the medium conveying apparatus of the first embodiment as described above is replaced with a different skew correction mechanism 71, and other components are the same as those of the medium conveying apparatus of the first embodiment as described above. FIG. 16 is a side view of the skew correction mechanism 71 and conveying paths of the medium conveying apparatus of the second embodiment. The skew correction mechanism 71 further includes a stopper 72 and a spring 73. The stopper 72 is supported by the image reading apparatus main body 2 so as to be able to rotate about the stopper rotation shaft 48 such that the stopper 72 is arranged at a separation conveying path blocking position or a retraction conveying path blocking position. The stopper 72 blocks the space between the junction point 10 and the medium separation conveying path 11 and is retreated from the space between the junction point 10 and the medium retraction conveying path 13 when the stopper 72 is arranged at a stopper separation conveying path blocking position. The spring 73 is formed of an elastic body and applies an elastic force to the stopper 72 such that when the stopper 72 is not arranged at the separation conveying path blocking position, the stopper 72 moves toward the separation conveying path blocking position.

Figure 17:
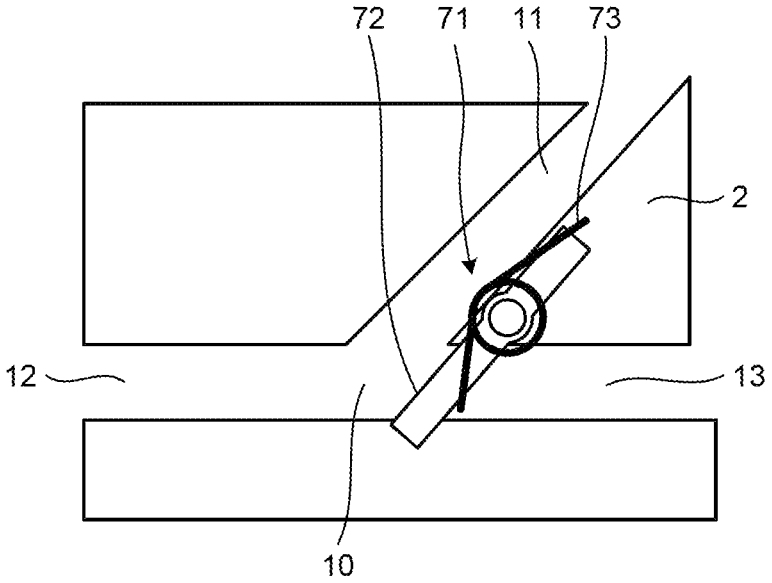
FIG. 17 is a side view of the skew correction mechanism and the conveying paths of the medium conveying apparatus of the second embodiment when a stopper is arranged at a retraction conveying path blocking position.

FIG. 17 is a side view of the skew correction mechanism 71 and the conveying paths when the stopper 72 is arranged at the retraction conveying path blocking position in the medium conveying apparatus of the second embodiment. The stopper 72 is retreated from the space between the junction point 10 and the medium separation conveying path 11 and blocks the space between the junction point 10 and the medium retraction conveying path 13 when the stopper 72 is arranged at the retraction conveying path blocking position.

When a thin medium that is conveyed along the medium separation conveying path 11 passes through the skew correction mechanism 71, a leading end of the medium hits against the stopper 72 of the skew correction mechanism 71 because the stopper 72 is arranged at the separation conveying path blocking position. After the leading end hits against the stopper 72, the thin medium is further conveyed by the separator 21, and therefor rotates such that a straight line along the leading end is parallel to the stopper rotation shaft 48, so that the skew is corrected. After the leading end is aligned with the stopper 72, the thin medium is further conveyed by the separator 21 and pushes the stopper 72 such that the stopper 72 rotates toward the retraction conveying path blocking position against the elastic force of the spring 73, and is fed to the junction point 10. The stopper 72 rotates by being pushed by the thin medium, and is arranged at the retraction conveying path blocking position. Therefore, the space between the junction point 10 and the medium retraction conveying path 13 is blocked by the stopper 72. The thin medium fed to the junction point 10 is prevented from entering the medium retraction conveying path 13 because the space between the junction point 10 and the medium retraction conveying path 13 is blocked. Therefore, the thin medium fed to the junction point 10 is fed to the medium read conveying path 12 in a state in which the skew is corrected. The medium conveying apparatus of the second embodiment is able to prevent the thin medium from entering the medium retraction conveying path 13 and appropriately convey the thin medium from the medium separation conveying path 11 to the medium read conveying path 12.

A thick medium conveyed along the medium read conveying path 12 and the medium retraction conveying path 13 is prevented from entering the medium separation conveying path 11 when passing through the junction point 10 because the stopper 72 is arranged at the separation conveying path blocking position. The medium conveying apparatus of the second embodiment is able to appropriately convey the thick medium along the medium read conveying path 12 and the medium retraction conveying path 13 by preventing the thick medium from entering the medium separation conveying path 11. By using the skew correction mechanism 71 also as a guide for switching between the conveying paths in which the medium is conveyed, the medium conveying apparatus of the second embodiment is able to reduce a manufacturing cost by simplifying the structure.

Meanwhile, the medium conveying apparatus according to the embodiments as described above is used for the image reading apparatus, but may be used for other apparatuses. Examples of the other apparatuses include a printer. For example, if the medium conveying apparatus is used for a printer, the lower side reader 26 is omitted and the upper side reader 27 is replaced with a printing unit that prints a graphic on a medium. Even if the medium conveying apparatus is used for apparatuses other than the image reading apparatus, by simplifying the structure by using the skew correction mechanism that corrects skew of a medium also as a guide for switching between the conveying paths in which the medium is conveyed, it is possible to reduce a manufacturing cost.

The medium conveying apparatus of the present disclosure is able to correct skew of a medium and simplify a structure for switching between conveying paths in which the medium is conveyed.

All examples and conditional language recited herein are intended for pedagogical purposes of aiding the reader in understanding the disclosure and the concepts contributed by the inventor to further the art, and are not to be construed as limitations to such specifically recited examples and conditions, nor does the organization of such examples in the specification relate to a showing of the superiority and inferiority of the disclosure. Although the embodiments of the disclosure have been described in detail, it should be understood that the various changes, substitutions, and alterations could be made hereto without departing from the spirit and scope of the disclosure.

What is claimed is:

1. A medium conveying apparatus comprising:

a first conveying path;

a second conveying path that is connected to the first conveying path;

a third conveying path that is connected to the first conveying path and the second conveying path;

a stopper configured to block a first space between the first conveying path and the second conveying path and retreat from the first space;

a lever that is rotatably supported by a main body so as to be arranged in one of a confinement region and a release region;

a first hitting portion that is fixed to the stopper; and a second hitting portion that is fixed to the lever, wherein the lever blocks the first space when the lever is arranged in the confinement region, the second hitting portion hits against the first hitting portion when the lever is arranged in the confinement region, the stopper is fixed while blocking the first space by the second hitting portion hitting against the first hitting portion, the lever is pushed by a medium conveyed along the first conveying path to move toward the release region, the lever and the stopper are formed to correct skew of the medium when the medium is in contact with both the stopper and the lever while the lever is arranged in the release region, the second hitting portion is prevented from hitting against the first hitting portion when the lever is arranged in the release region, the stopper is released so as to retreat from the first space by preventing the second hitting portion from hitting against the first hitting portion, and the stopper is further configured to:

retreat from a second space between the second conveying path and the third conveying path when the stopper blocks the first space; and block a third space between the first conveying path and the third conveying path when the stopper retreats from the first space.

2. The medium conveying apparatus according to claim 1, further comprising:

a conveyor configured to convey a medium from the second conveying path to the third conveying path or from the third conveying path to the second conveying path when the stopper is retreated from the second space, wherein the conveyor conveys a medium from the first conveying path to the second conveying path when the stopper is retreated from the first space.

3. The medium conveying apparatus according to claim 2, wherein the stopper is supported by the main body such that the stopper is rotatable about a rotation shaft, and the rotation shaft is arranged between the first conveying path and the third conveying path.

4. The medium conveying apparatus according to claim 3, further comprising:

an abutment configured to be fixed to the main body so as to be separated from the stopper when the stopper is retreated from the second space and so as to contact with the stopper when the stopper blocks the third space.

5. The medium conveying apparatus according to claim 3, wherein the lever moves from the release region to the confinement region by separating from the medium.

6. The medium conveying apparatus according to claim 5, wherein the lever blocks the third space when the stopper blocks the third space.

7. The medium conveying apparatus according to claim 3, further comprising:

an elastic body configured to apply an elastic force to the stopper such that the stopper blocks the first space.

* * * * *